United States Patent [19]

Lärkfeldt

[11] 4,342,713

[45] Aug. 3, 1982

[54] PROCESS AND DEVICE FOR PRODUCTION OF CONCRETE PIPE BY FILLING AND COMPACTION OF FRESH CONCRETE IN AN UPRIGHT FORM

[75] Inventor: Owe C. G. Lärkfeldt, Täby, Sweden

[73] Assignee: AB Skanska Cementgjunteriet, Danderyd, Sweden

[21] Appl. No.: 194,592

[22] Filed: Oct. 6, 1980

[30] Foreign Application Priority Data

Oct. 12, 1980 [SE] Sweden ..... 7908482

[51] Int. Cl.[3] ..... B28B 1/08; B28B 7/18; B28B 21/12; B28B 21/14

[52] U.S. Cl. ..... 264/71; 264/333; 425/426; 425/428; 425/432; 425/435

[58] Field of Search ..... 264/71, 72, 333; 425/432, 426, 435, 428

[56] References Cited

U.S. PATENT DOCUMENTS

| | | | |
|---|---|---|---|
| 765,939 | 7/1904 | Rozier | 425/432 X |
| 1,203,543 | 10/1916 | Haymaker et al. | 425/425 |
| 1,810,583 | 6/1931 | Tuerck | 425/426 X |
| 2,091,385 | 8/1937 | Trickey | 425/432 |
| 2,356,852 | 8/1944 | Hutchinson | 264/72 |
| 2,585,756 | 2/1952 | Eschenbrenner | 425/432 X |
| 2,839,278 | 6/1958 | Rowe | 425/432 X |
| 2,845,682 | 8/1958 | Eschenbrenner | 425/426 |
| 3,752,626 | 8/1973 | Trautner et al. | 425/432 X |

FOREIGN PATENT DOCUMENTS

| | | | |
|---|---|---|---|
| 128163 | 5/1950 | Sweden . | |
| 133752 | 11/1951 | Sweden | 425/432 |
| 143954 | 2/1954 | Sweden . | |
| 154457 | 5/1932 | Switzerland | 425/426 |
| 610040 | 10/1948 | United Kingdom . | |
| 834329 | 5/1960 | United Kingdom | 425/432 |

*Primary Examiner*—Philip Anderson
*Attorney, Agent, or Firm*—Pennie & Edmonds

[57] ABSTRACT

A process and a device for producing concrete pipe by filling and compacting fresh concrete in an upright casting form. An outer jacket surrounding a vibrator-equipped core is rotated around its geometric axis with an internal peripheral speed which is greater than the maximum vibrational speed at which said core acts on the fresh concrete during compaction, said vibrational speed being the product of the amplitude and frequency at which the core vibrates. Around its circumference, the outer jacket has axially distributed roller paths for cooperation with rotationally journalled rollers which can be pressed against them. At least one roller is driven and is a drive means for rotating the jacket, the others being non-driven support rollers. All rollers are mounted on a frame member around the outer jacket of the casting form.

6 Claims, 2 Drawing Figures

Figure 2:
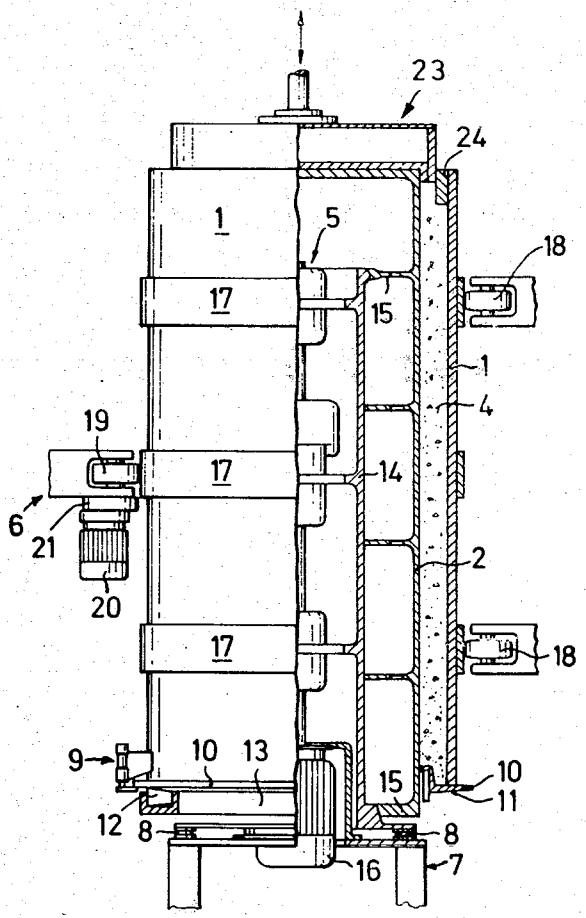

PROCESS AND DEVICE FOR PRODUCTION OF CONCRETE PIPE BY FILLING AND COMPACTION OF FRESH CONCRETE IN AN UPRIGHT FORM

The present invention relates to the production of concrete pipe by filling and compaction of fresh concrete in an upright form, which comprises an outer jacket and a core within the same which is provided with a vibrator. More specifically, the invention relates both to a process and a device for such pipe production.

In casting concrete pipe in a form of this type, vibration of the core provides a mechanical treatment of the fresh concrete filled between the outer jacket and the core of the form, which treatment results in a compaction of the fresh concrete. This treatment with subsequent compaction, which drives air out of the fresh concrete and makes it homogeneous and dense, occurs regardless of whether the core vibrator imparts a directed or rotating vibration movement to the core.

Regardless of whether the core performs a directed or rotating vibrating movement, both the inner and the outer surfaces of the pipe will have open pores. Selling and quality considerations make it desirable, however, to have more attractive, denser and smoother surfaces on the pipe, especially at the joint surfaces. Up to now one has attempted to solve this problem by, in addition to vibrating the core, also vibrating the outer jacket horizontally with the aid of several vibrators. It was thought that this would provide an especially effective compaction of the fresh concrete. Since even separately driven vibrators connected by interacting parts automatically adjust their operation to the same phase, and the core and outer jacket will thus move as a unit, no significant improvement of the pipe surfaces seems to have been possible by means of this process.

The known process of subjecting, during the pipe casting, both the outer jacket and the core of the form to essentially horizontally directed vibrations has, however, been further developed by proposing a displacement of the vibrations for the outer form by at least 45° in relation to the vibrations of the core. In practice this seems to have resulted in a phase shift-up 180° between the vibrations of the core and the outer jacket. This is achieved by means of various excentric vibrators which rotate synchronously at the same speed and direction. Even if it were possible to thereby improve the outer surface of the pipe without accompanying appreciable decrease in the quality of the inner surface, this further developed process does not, however, constitute an acceptable solution to the problem of producing, with simple and uncomplicated forms, concrete pipe which in addition to high concrete quality also has high surface fineness both internally and externally. The upright form required for carrying out the latter of the two known processes is also unnecessarily complicated, costly and bulky as a result of the fact that it must always include at least two vibrators, also requiring extra dampening means and balancing weights in addition to the synchronizing and driving means for the vibrators.

The primary purpose of the present invention is therefore to suggest a new process of the type described in the introduction, which provides high-quality concrete in the pipe and simultaneously high surface fineness to the inside and the outside of the pipe without requiring the upright casting form to be unnecessarily complicated with a number of vibrators with accompanying difficult demands as regards structural design, dampening and space.

This purpose is essentially achieved primarily by the fact that the outer jacket of the casting form in the process according to the invention, during at least a portion of the compacting of the fresh concrete, is kept in rotation around its geometrical axis with an internal peripheral speed which is higher than the maximum vibrational speed at which the vibrator-equipped core acts on the fresh concrete during its compaction. What is meant here by vibrational speed is the product of the amplitude and the frequency at which the core vibrates.

Thus in the process acccording to the invention the outer jacket of the form is kept in active rotation during at least a portion of the time during which the fresh concrete is compacted by vibration of the form core. The fresh concrete in the casting form is thus subjected to centrifuging at the same time as it is vibrated. This double working means that the water content of the fresh concrete can be very low, i.e. that the fresh concrete can have a stiff consistency. This means in turn that the fresh concrete will have a good ability to fill out the form space as well as high strength and high density in the finished pipe. It also makes the newly cast pipe so shape-stable that the form can be removed practically immediately after the casting has been completed without the risk of setting in the fresh concrete. If the rotation of the outer jacket of the form is maintained after the vibration of the core has stopped, the core can be drawn out practically without the occurrence of setting-inducing frictional forces between the core and the fresh concrete which is still rotating together with the outer form. This means, quite surprisingly, that the form removal from the inside of a newly cast pipe can be accomplished without producing pores and scratches on the inner surface of the pipe. The inner surface will be completely smooth. It has also been possible to remove the forms from the outer surface of the pipe after the rotation of the outer jacket has stopped, without major frictional forces arising between the jacket and the pipe, the outer surface of which will also thus be entirely smooth as a result of the double treatment which the fresh concrete has been subjected to by simultaneous vibration of the form core and active rotation of the outer jacket of the form. The smooth inner and outer surfaces thus distinguish concrete pipe made according to the inventive process in an especially advantageous manner from the appearance of conventional, vibrated concrete pipe.

In spite of the fact that the process according to the invention involves a double treatment of the fresh concrete in the casting form, it does not require any complicated or bulky form means. On the contrary, a device made according to the invention for carrying out the new process is significantly more simple and less bulky than the previously proposed form devices in which both the outer jacket and the core of the form are vibrated.

A device according to the invention with a vibrator-equipped core and upright outer jacket, which is arranged for rotation around its geometric axis and is provided with drive means to provide the required rotation to the jacket, is primarily characterized in that the outer jacket is provided around its periphery with a number of roller paths distributed axially to the outer jacket, said paths being intended to cooperate with a number of rotationally journalled rollers which can be placed in contact with said paths, at least one of said rollers being driven and constituting a drive means for achieving rotation of the jacket and the rest being non-driven and constituting support rollers during the rotation of the jacket, all of said rollers being mounted on a frame member around the outer jacket of the form. In contrast to the known devices for achieving jacket vibration, only simple auxiliary means are required for driving, journalling and supporting the jacket in a device constructed according to the invention.

In order to give the pipe ends the intended shape, it is of course necessary in a device according to the invention, as it is in the known casting forms for pipe production, to have special form parts. For example, in an advantageous embodiment of a device according to the invention, the outer jacket can be detachably connected at its lower end with an annular form member for creating one end of a concrete pipe. Said form member can for example be a so-called socket ring which surrounds, with a small gap, the vibrator-equipped core of the form. In this embodiment the annular form member for shaping one end of the pipe can even be used as a part of an axial journalling arrangement for the rotation of the outer jacket. Said annular form member can have, on its inner side facing away from the casting form, a race which, together with roller bodies directed against the same and carried by a member extending radially from the form core, constitutes an axial bearing for the rotational movement of the outer jacket.

The corresponding form portion for the shaping of the other end of the pipe can suitably be rotatable with the outer form and is then also preferably annular and carried by a pressing member which is arranged on top of the device according to the invention and which is at least partially insertable into the space between the outer jacket and the core.

The invention will be described in more detail below with reference to the accompanying drawing, which shows primarily an example of an embodiment of the device according to the invention but which also gives an idea of the inventive process. Both of the figures in the drawing show simplified side views from which non-essential details have been removed, in partial section, of a device for producing concrete pipe according to the inventive process by filling and compacting fresh concrete in an upright form.

Figure 1:
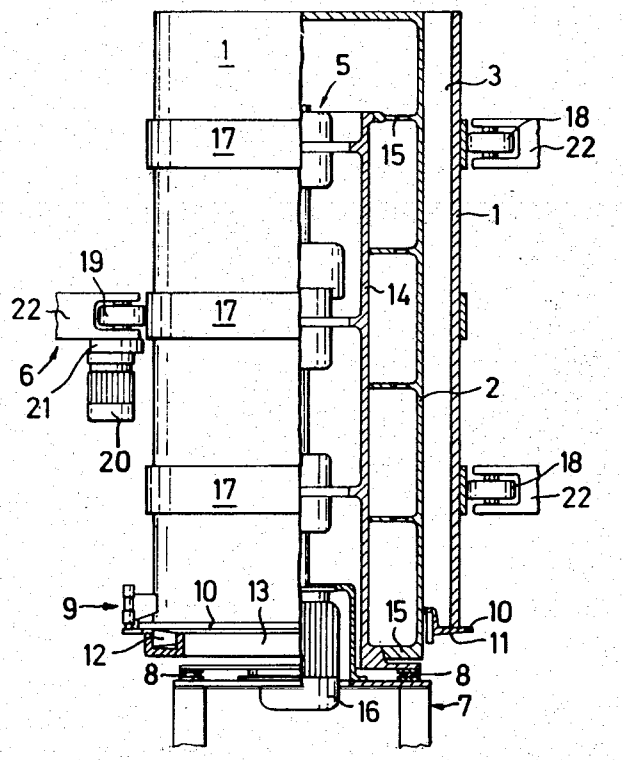

FIG. 1 shows the device prior to casting and filling the form space with fresh concrete, while FIG. 2 shows the device at the end of the casting process after the form space has been filled and closed.

It is evident from the drawing that a device according to the invention comprises an upright form, which in turn comprises an outer jacket 1 and a core 2 located therein. Between the outer jacket and the core there is an annular space 3. For casting concrete pipe, suitably conditioned fresh concrete 4 is poured into this space where the concrete is compacted by vibrating the core 2 and rotating the outer jacket 1. For this purpose, the core is provided on its inside with a vibrator 5, and the outer jacket is disposed for rotation around its geometric axis and has drive means 6 which impart it the required rotation. If reinforced concrete pipe is to be produced in the device, the reinforcements are of course disposed in the form space 3 before the concrete is poured in.

A device according to the invention can be constructed in many different ways. This is especially true with regard to the form removal from the cast pipe. The removal of the form from the outside of the pipe can be accomplished either by the outer jacket of the form being divided lengthwise and being opened, or by the outer jacket being displaceable axially relative to the core. The form removal from the inside of the pipe can be accomplished either by lifting the pipe off vertically from the core, or by the core itself being displaceable axially within the cast pipe and drawn out either upwards or downwards. In the embodiment shown here, however, the outer jacket 1 can either be divided lengthwise or be liftable upwards in relation to the cast pipe, whereafter the form is removed from the inside of said pipe by lifting off the pipe from the core.

As is evident from the drawing, in the embodiment shown here of a device according to the invention, both the outer jacket 1 and the core 2 are supported by a base 7 via elastic members 8, e.g. in the form of rubber inserts. More specifically, in the casting process the outer jacket 1 is joined at its lower end, by means of a number of releasable clamps 9, to an annular member for achieving the appearance of one end of the concrete pipe, said member in the present example having the shape of a so-called socket ring 10 which surrounds the form core 2 with a small gap. This annular form member or socket ring 10 has, on its side 11 facing away from the form space, a bearing race. Together with roller bodies 12 in contact with the same, this race forms an axial bearing for the rotational movement of the outer jacket 1 around the form core 2 from the lower portion of which a radially extending flange 13 or the like supports the roller bodies 12.

In a device according to the invention, the form core 2 can be constructed in several different ways. It can either be provided with a vibrator which provides a so-called directed vibration, meaning that the core hammers against the fresh concrete from one side to the other, or the core can have a vibrator which provides a so-called rotating vibration, whereby the outside of the core performs a sliding or rolling movement against the fresh concrete. In the embodiment shown here for the device according to the invention, the form core 2 is provided with a vibrator 5 of the first-mentioned type. It is arranged inside a pipe 14 which is joined by means of two annular supporting flanges 15 to the jacket of the core 2. The vibrator is driven by an electric motor 16 arranged at the lower end of the core and supported by the base 7. More specifically, the vibrator is of the type described in detail in Swedish Pat. No. 204 265, and will therefore need no closer description here but it will suffice to mention that it comprises two excentric elements arranged on the same geometric axis and rotating in opposite directions. One of these excentric elements is divided into two groups with individual excentric mass(es), one arranged at the upper portion of the core and the other at the lower portion, with the second excentric element arranged between them and rotatable in the opposite direction to the first-mentioned excentric elements divided into two parts or groups.

For its rotation, the outer jacket 1 of the form in the embodiment shown here for a device according to the invention is provided with a number of roller paths 17. Said paths are distributed axially along the jacket and are designed to cooperate with a number of rotationally journalled rollers 18,19 which can be pressed against them. At least one 19 of the rollers is driven by an electric motor 20 via a reduction gear 21. This roller 19 is the actual drive means for achieving rotation of the jacket 1 and is therefore in frictional engagement with its cooperating roller path 17 on the jacket. The rest of the rollers 18 shown are non-driven and act as support rollers for the jacket. All of the rollers, both driven and non-driven, interacting with the roller paths of the jacket, are evenly spaced around the roller paths of the jacket and are rotationally journalled in a frame member around the outer jacket, only a small portion 22 of said frame member being shown in the drawing.

As can be seen best in FIG. 2, a device according to the invention can also be provided with a pressing member 23 disposed above the form and movable axially to the same. This pressing member is suitably constructed so that it is at least partially insertable from above into the annular space 3 for the fresh concrete between the outer jacket 1 and the core 2 of the form. After filling of the casting form, the fresh concrete is pressed down into said form with the aid of the pressing member. Actually, the pressing member 23, in addition to being raisable and lowerable, can also be rotationally journalled, so that it participates in the rotational movements of the outer jacket 1. It can also carry to advantage an annular form portion 24 for shaping one pipe end, said form portion in the device shown in FIG. 2 being a so-called point ring.

After the annular space 3 between the outer jacket 1 and the core 2 has been filled with suitably conditioned fresh concrete 4, which can be done to advantage with the core 2 vibrating and possibly the outer jacket slowly rotating, the outer jacket, during at least a portion of the compacting of the fresh concrete, is made to rotate around its geometric axis with an internal peripheral speed which is greater than the maximum vibrational speed at which the vibrator-equipped core 2 acts on the fresh concrete as it is compacted. The term vibrational speed refers here to the product of the amplitude and the frequency at which the form core 2 vibrates and acts on the fresh concrete in the casting form.

The combination of core vibration and active rotation of the outer jacket produces in a zone in the fresh concrete a pressure which corresponds to the sum of the excentric force of the core and the centrifugal force caused by the jacket rotation, while the pressure in the fresh concrete in a diametrically opposite zone corresponds to the difference between these two forces. This means that the core during its vibration reduces or even temporarily ceases its contact with the fresh concrete in the casting form on a portion of its circumference, while the contact is instead that much more pronounced on the portion of the circumference located diametrically opposite the first-mentioned portion. The movement of the core in relation to the fresh concrete in the form, enabled by the invention, means that in this embodiment of the inventive device the core, with its form core subjected to so-called directed vibration, will perform with its outside a hammering trowelling movement against the fresh concrete which provides the finished pipe with a pore-free and smooth internal surface, at the same time as the rotation of the outer jacket provides a smooth and pore-free external pipe surface.

After the form has been filled with fresh concrete and the pressing member 23 has been lowered for closing the form and for creating the so-called overpressure on the fresh concrete inside the form, the rotation of the outer jacket may be maintained after the vibration of the core has stopped until the core has been withdrawn from the form revealing the inside of the cast pipe. This requires, however, another embodiment of the invention than that shown here.

The invention is not limited to the example described here and shown in the drawing. Rather, it can be modified in many ways within the scope of the patent claims.

What I claim is:

1. Process for producing concrete pipe by filling and compacting fresh concrete in an upright casting form, comprising an outer jacket and a vibrator-equipped core located therein, characterized in that the outer jacket, during at least a portion of the compaction of the fresh concrete, is kept in rotation around its geometric axis with an internal peripheral speed which is greater than the maximum vibrational speed at which the vibrator-equipped core acts on the fresh concrete during the compacting thereof, the vibrational speed being the product of the amplitude and the frequency at which the core vibrates.

2. Process according to claim 1, characterized in that the rotation of the outer jacket is maintained after the vibration of the core has ceased and until the core has been withdrawn from the casting form to reveal the inside of the cast pipe.

3. Device for the production of concrete pipe by filling and compacting of fresh concrete in an upright casting form, which comprises an outer jacket and a vibrator-equipped core located therein, the outer jacket being arranged for rotation around its geometric axis and being provided with drive means whereby the jacket is imparted the required rotation, characterized in that the outer jacket is provided around its circumference with a number of roller paths distributed axially along the same, said paths being intended to cooperate with a number of rotationally journalled rollers which can be pressed against the paths, at least one of said rollers being driven by a drive means for achieving rotation of the jacket and the others being non-driven and being support rollers during the rotation of the jacket, all of the rollers being mounted on a frame member around the outer jacket of the form, controllable vibrator means to vibrate the core to act on fresh concrete and jacket drive means for providing required rotation to the jacket whereby said controllable vibrator means and said jacket drive means are operable such that the internal peripheral speed of the outer jacket is greater than the maximum vibrational speed which the core acts on the fresh concrete.

4. Device according to claim 3, characterized in that the outer jacket is at its lower end detachably joined to an annular form portion for creating one end of a concrete pipe, said portion surrounding the core of the form with a small play.

5. Device according to claim 4, characterized in that the annular form portion has, on its side facing away from the interior of the form, a bearing race which, together with roller bodies in contact with the same and carried by a member radially extending from the core, is an axial bearing for the rotational movement of the outer jacket.

6. Device according to claim 3 having in addition a top pressing member at least partially insertable in the space between the outer jacket and the core, which member can be rotatable together with the outer form and suitably carries an annular form portion for creating one end of the concrete pipe.

* * * * *